United States Patent [19]

Zorini et al.

[11] Patent Number: 4,549,414

[45] Date of Patent: Oct. 29, 1985

[54] KNITTING MACHINE TO PRODUCE FIGURED FABRICS

[75] Inventors: Luigi O. Zorini, Cilavegna; Walter Zorzoli, Vigevano; both of Italy

[73] Assignee: Comez S.p.A., Cilavegna, Italy

[21] Appl. No.: 523,122

[22] Filed: Aug. 15, 1983

[30] Foreign Application Priority Data

Oct. 21, 1982 [IT] Italy ..... 23856 A/82

[51] Int. Cl.[4] ..... D04B 27/10

[52] U.S. Cl. ..... 66/203; 66/204; 66/207; 66/214

[58] Field of Search ..... 66/203, 214, 207, 204

[56] References Cited

U.S. PATENT DOCUMENTS

| | | | |
|---|---|---|---|
| 3,303,670 | 2/1967 | Bassist | 66/207 |
| 4,141,230 | 2/1979 | Kohl | 66/204 |
| 4,331,009 | 5/1982 | Kohl | 66/203 |
| 4,417,456 | 11/1983 | Bergmann et al. | 66/214 |
| 4,448,047 | 5/1984 | Romano | 66/207 |

*Primary Examiner*—Ronald Feldbaum
*Assistant Examiner*—Mary A. Ellis
*Attorney, Agent, or Firm*—Balogh, Osann, Kramer, Dvorak, Genova & Traub

[57] ABSTRACT

The invention particularly relates to an improved knitting machine to produce figured fabrics.

The knitting machine has high working capacity and is capable of producing various patterned and colored fabrics. This improved knitting machine comprising rods suitable to support tubular weft yarn guides disposed side by side on plates parallel to the needle bar and transversely to the needle plane, the plates being movable along their own plane and parallelly to the needle bar in order to define the working oscillations of the rods, and characterized in that the rods are rotatably supported by pivot pins that are fixedly engaged with the plates, the pivot pins protruding at right angles from the same plates, in that it is provided with stop members for the rods designed to allow the same to oscillate symmetrically with respect to vertical planes and to cause the maximal linear amplitude of the tubular weft yarn guides which corresponds to the double distance of two needles in succession, and in that selection and control members are provided which include a plurality of kinematic chains suitable to position each of the rods angularly and independently of the adjacent rods.

17 Claims, 19 Drawing Figures

KNITTING MACHINE TO PRODUCE FIGURED FABRICS

FIELD AND BACKGROUND OF THE INVENTION

The present invention relates to an improved weaving machine to produce figured fabrics, that is fabrics having different colors and patterns and particularly to a knitting machine of the kind in which a "crochet-machine" and a "jacquard device" are associated on the same bearing frame.

It is known that there have been on the market for a long time knitting machines known as crochet-machines. These machines have a rather simple structure and are suitable to produce simple knitted figured fabrics. These machines have become particularly versatile and sophisticated when the so-called "jacquard device" has been applied thereto. Owing to the presence of this device which is disposed above the crochet-machine, it is possible to achieve very elaborate fabrics.

It was found, however that the combination of a crochet-machine with a jacquard device is not sufficient to allow the achievement of very figured fabrics having a great variety of colors and patterns. Furthermore, it was found that known machines can give good results only if they are suitably arranged in order to obtain a determined fabric. In other words, many problems arise with these machines when it is necessary to change the type of fabric to be produced.

This is a rather unfavorable situation when these machines have to be used to produce fabrics that are particularly subjected to the fashion and to the changing of the same. In this case the presence of a knitting machine suitable to change its production without giving rise to particular problems is required. This kind of universal machine giving products of high quality is particularly required by the middle-sized factories in order to obtain all types of fabrics by means of a sole machine of a general kind.

In this context it is also necessary that a knitting machine having reduced overall dimensions and suitable to be located in places that are not especially arranged for the purpose should be available. In fact, it should be understood that the crochet-machines of the known art, provided with a jacquard device, have very big vertical dimensions as said jacquard device is disposed above the crochet-machine. This arrangement is necessary as it is required that the yarns unwound from the jacquard device and directed towards the crochet-machine should not get entangled.

Furthermore, it is not possible to reduce the height dimensions of the jacquard device without considerably altering the device itself.

OBJECTS

In this situation the technical task on which the present invention is based is to conceive a knitting machine having the above features as to its versatility, high quality level and possibility to be readily fitted for the production of different kinds of fabrics.

Within the scope of this technical task it is an important object of the present invention to conceive a knitting machine suitable to obtain the most varied kinds of fabrics by simply changing the program controlling the machine.

A further important object of the present invention is to conceive a substantially new knitting machine particularly efficient in all its technical devices, although the basic structure of the same is the result of the combination of a crochet-machine and a jacquard device.

A still further object of the present invention is to conceive a knitting machine having reduced overall dimensions, particularly reduced height dimensions, in order to allow the positioning of the machine in any room having a suitable area.

SUMMARY OF THE INVENTION

These and still further objects that will become more apparent in the following are attained by an improved knitting machine according to the invention for the production of figured fabrics, that is having different colors and patterns, of the kind associating a crochet-machine and a jacquard device on a sole bearing frame and comprising active members such as a needle-bar movable in an axial direction to the needles, a warp yarn guide bar disposed adjacent the needles and suitable to oscillate in a direction parallel to the lying plane of the needles and to rotate perpendicularly to the same plane, an under-yarn guide bar suitable to oscillate in a direction parallel to the needle plane and perpendicularly to the same, a projection carrier bar movable at right angles to the needle plane, rods suitable to support tubular weft yarn guides disposed side by side on plates parallel to said needle bar and transversely to the needle plane, said plates being movable along their own plane and parallelly to said needle bar in order to define the working oscillations of said rods; and further comprising selection and control members for said active members designed to cause the same active members to intervene according to a predetermined program, as well as feeding devices for the yarns forming the fabric and conveying means for the produced fabric; said knitting machine being characterized in that said rods are rotatably supported by pivot pins that develop at right angles to said plates, in that is provided with stop members for said rods designed to allow the same to oscillate symmetrically with respect to vertical planes and to cause the maximal linear amplitudes of said tubular weft yarn guides which correspond to the double distance of two needles in succession, and in that said selection and control members include a plurality of kinematic chains suitable to position each of said rods angularly and independently of the adjacent rods.

Advantageously, said selection and control members comprise hooked needles, a trailing device for said hooked needles, control needles for said hooked needles and a selection drum for said hooked needle control needles, and they are characterized in that they are disposed at the side of said active members, tie rods being provided for connecting said hooked needles to said rods having a prevalently horizontal development, at the inside of metal sheaths supported by a frame mounted above said rods.

Further features and advantages will become more evident from the description of a preferred but not exclusive embodiment of the invention, given hereinafter by way of example only, with reference to the accompanying drawings, in which:

DESCRIPTION OF THE PREFERRED EMBODIMENT

Figure 1:
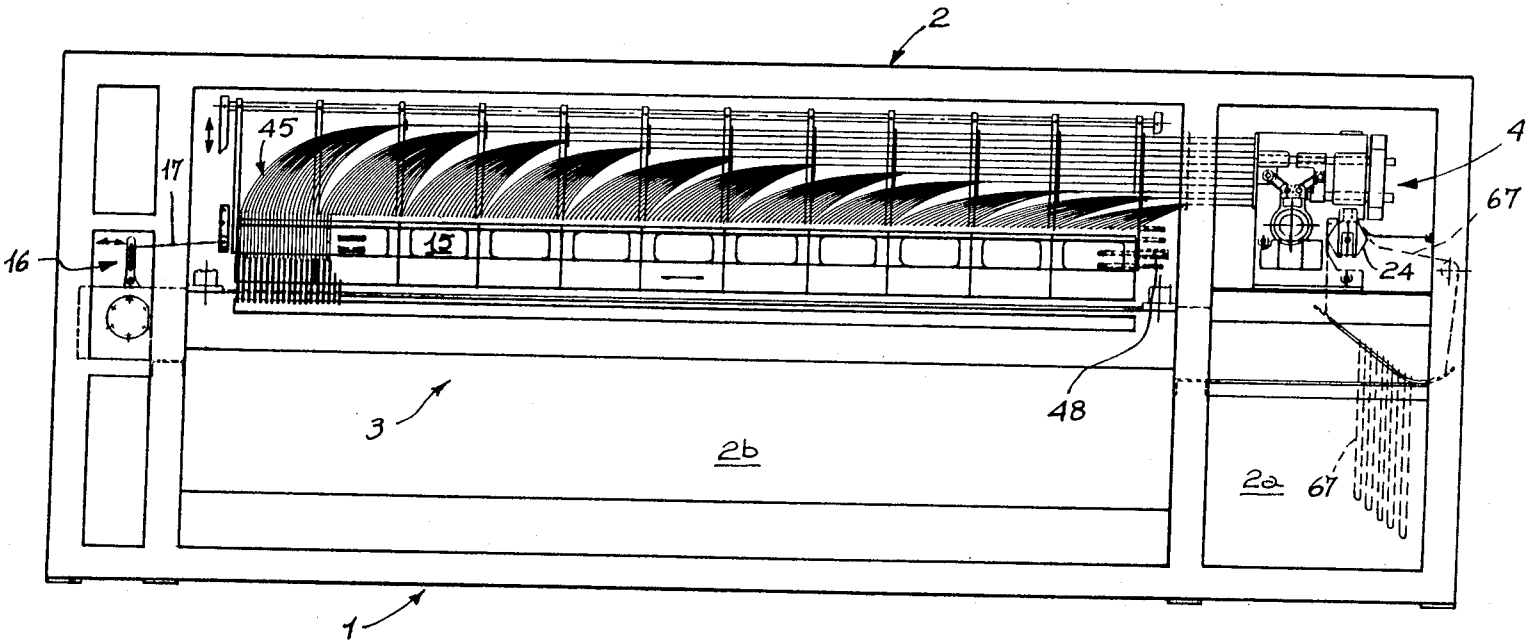
FIG. 1 is a diagrammatic front view of the machine as a whole, according to the invention.

Referring to the drawings, the knitting machine according to the invention is generally indicated at 1. Summarily, it is provided with a bearing frame 2 having a prevalently horizontal development and supporting a crochet-machine 3 and a jacquard device 4 disposed side by side.

Figure 2:
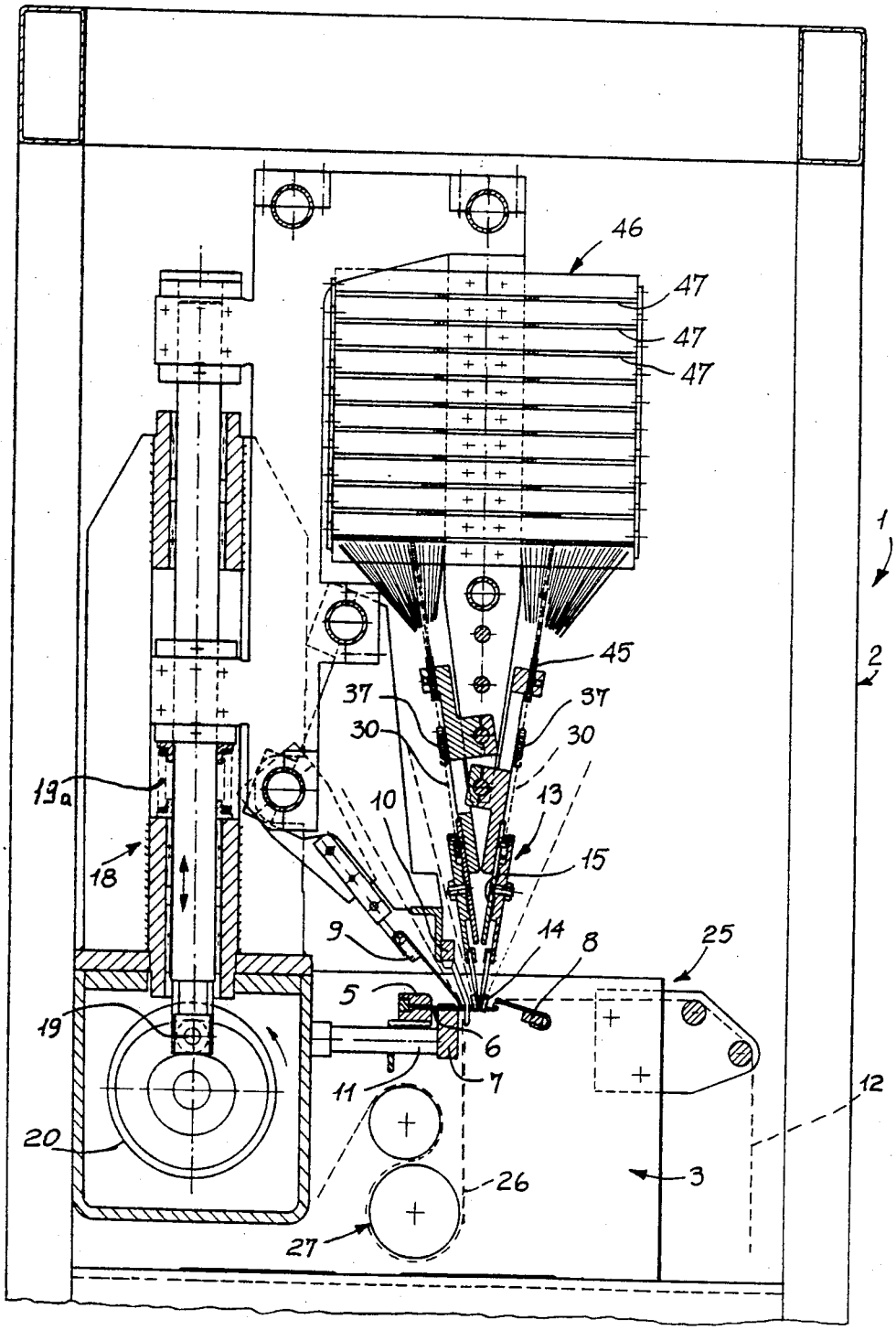
FIG. 2 is a side sectional view of the machine as a whole.

More particularly, the knitting machine according to the invention includes, in a known manner and as particularly seen in FIG. 2, a needle-bar 5 provided with needles 6, a front grooved bar 7, a warp yarn guide bar 8, an under-yarn guide bar 9 and a projection carrier bar 10.

Needles 6 are disposed side by side so that they define a needle lying plane or needle-plane and are axially movable under the action of the needle-bar 5 provided with a reciprocating motion along guides 11 supporting the front grooved bar 7. The role of the latter is to slidably support the needles 6.

The warp yarn guide bar 8 guides the warp yarn 12 and is disposed close to the needle hooks. The warp yarn guide bar 8 is provided with a first oscillating motion parallel to the needle plane 6 and with a second movement of rotation perpendicular to the same plane. The under-yarn guide bar 9, on the contrary, can oscillate parallelly to the needle plane 6 and at right angles to the same plane. Finally, the projection carrier bar 10 is only movable at right angles to the needle plane 6.

In a known manner, rods 13 supporting tubular weft yarn guides 14 are provided, which are disposed side by side on plates 15 that are parallel to the needle-bar 5 and that cross the needle plane 6.

Figure 3:
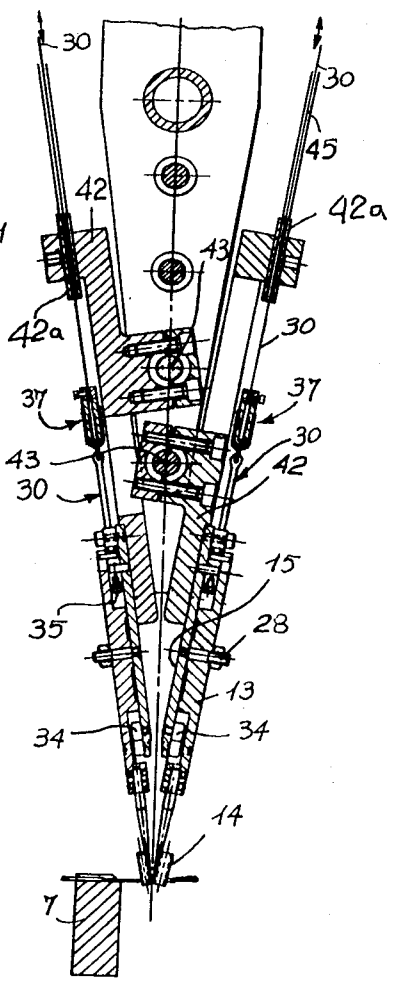
FIG. 3 shows a detail of FIG. 1 to an enlarged scale.
Figure 5:
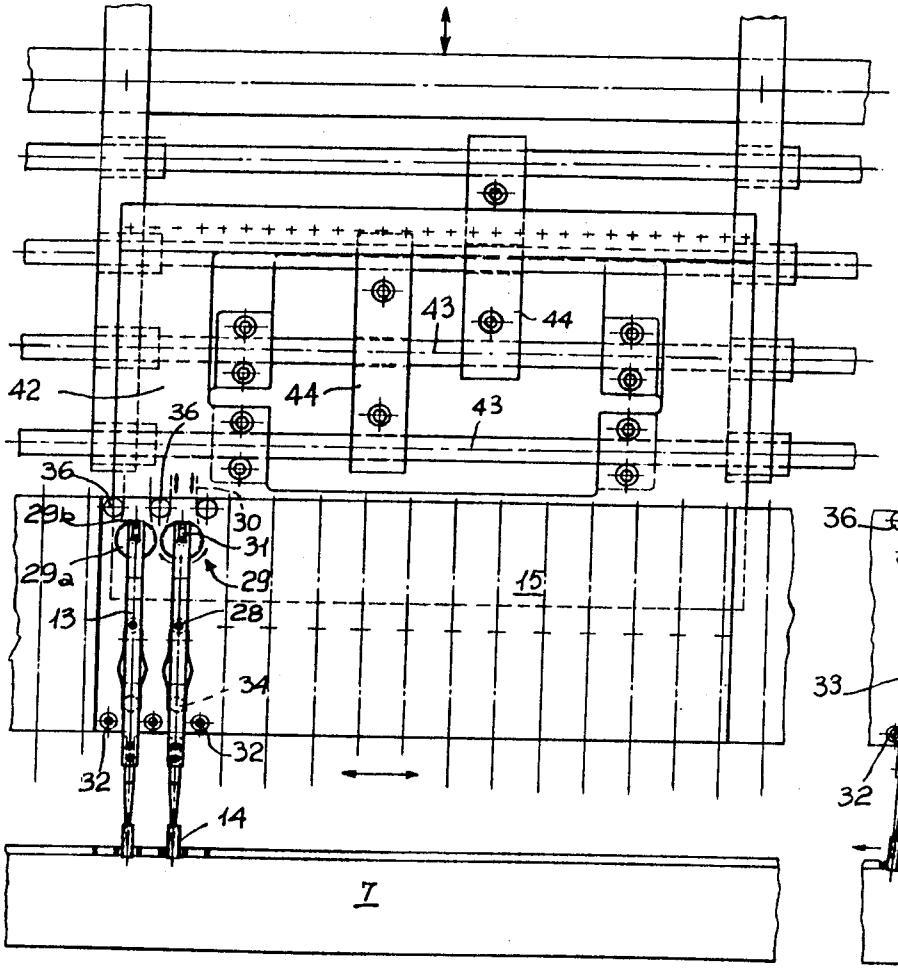
FIG. 5 shows a detail of FIG. 3 according to an angle rotaed through 90°.

Plates 15, particularly shown in FIGS. 3 and 5, are movable in their own plane in order to define the working oscillations of rods 13. More particularly, plates 15 are movable parallelly to the needle-bar 5 and also according to the predominant direction of development of rods 13.

As shown in the figures, two groups of plates 15 are provided, which have their corresponding rods disposed obliquely with respect to each other and converging towards the needles 6 from an angular position approaching the vertical.

In a known manner too, selection and control members are provided for all the above mentioned active members, which directly contribute to the production of the fabric next to the needles 6.

These members comprise, for example, an oscillating lever 16 which, by means of a tie rod 17 (FIG. 1) controls the movement of plates 15 in a direction parallel to the needle-bar 5, and a column-shaped support 18 (FIG. 2) controlling the vertical motion of plates 15, of the underyarn guide bar 9, as well as of the projection carrier bar 10.

Advantageously the support 18, at its lower portion is provided with a cam follower 19, trapped between a double cam 20, and it is balanced by a support spring 19*a* that substantially eliminates the weight of the support 18 on the cam follower 19.

The selection and control members also comprise, as shown in FIGS. 7 to 10, hooked needles 21, already known in themselves, a trailing device 22 for said hooked needles 21, needles 23 controlling said hooked needles and a drum 24 for the selection of needles 23 controlling said hooked needles.

The needles 23 that control said hooked needles as well as the drum 24 are already known in the art, but in this embodiment according to the invention they are interconnected and structured in a completely new manner together with the trailing device 22 and the hooked needles 21, as more clearly shown in the following; in addition, they are advantageously located adjacent the plates 15 provided with their corresponding rods 13, in a suitable compartment 2*a* (FIG. 1) of the bearing frame 2, next to which there is a second compartment 2*b* accommodating the members seen in FIG. 2.

Summarily, the structure of the knitting machine 1 also comprises feeding devices 25 for the fabric forming yarns 26, not shown in the drawings, as well as conveying devices 27 for the produced fabric, these devices being for example rollers.

More particularly, and referring above all to FIGS. 3 to 6, it can be observed that a fundamental feature of the knitting machine 1 according to the invention is the technical solution concerning rods 13 and their control members.

In fact it is provided that rods 13 are pivotally mounted on pivot pins 28 projecting at right angles from plates 15. The pivot pins 28 engage with rods 13 in a position intermediate the same: therefore each rod oscillates both at its lower end, provided with said tubular weft yarn guides and at its upper end where the kinematic chain controlling the angular position of the same rod is attached. This kinematic chain is carried out in a novel way, by means of a crank 29, of tie rods 30 controlled by said crank 29 and of said hooked needles 21 to which the tie rods 30 are connected. The kinematic chain, as already explained before in short, comprises, beyond the hooked needles 21, a trailing device 22 for the hooked needles 21 as well as needles 23 controlling said hooked needles and a selection drum 24 for said needles 23.

Figure 6:
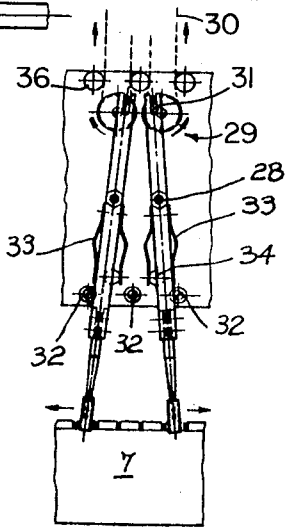
FIG. 6 shows some elements seen in FIG. 5 to the same scale and during different operating steps.

FIGS. 3, 5 and 6 show that the cranks 29 include wheels 29*a* rotatable about their central axis parallel to pivot pins 28, and pegs 29*b* projecting from the edge of the wheels 29*a*. Pegs 29*b* are introduced into slots 31 obtained in rods 13 and therefore, as shown in FIG. 6, the rotation of wheels 29*a* constrains the rods 13 to oscillate angularly about the pivot pins 28.

The oscillations of rods 13 are restrained by means of stop means formed by fixed abutments 32 protruding from plates 15 and disposed between the pivot pins 28 and the tubular weft yarn guides 14. Said fixed abutments 32 are symmetrical with respect to the pivot pins 28 and they are spaced from each other so as to allow rods 13 to perform oscillations that lead to maximal linear amplitudes of the tubular weft yarn guides, which corresponds to the double distance between two adjacent needles 6. Furthermore, the oscillations of rods 13 are counteracted by substantially flat-shaped return springs 33 having one of their ends fixed to the rods 13 next to the pivot pins 28, while the other end thereof is free and contacts a fixed projection 34 integral to plates 15. The projection 34 is disposed in line with the axis of rods 13 when the latter are disposed in the middle between two stop members or fixed abutments 32, as shown in FIG. 5.

In a novel way it is provided that each crank 29 should be controlled by two tie rods 30, each of them leading to a specific hooked needle 21. FIG. 3 shows that the two tie rods 30 of each crank 29 are secured by means of a screw 35 to a point of the same crank diametrically opposed with respect to the securing point of peg 29. Wheels 36 placed above each crank 29 ensure the adhesion of tie rods 30 to the same cranks.

Figure 4:
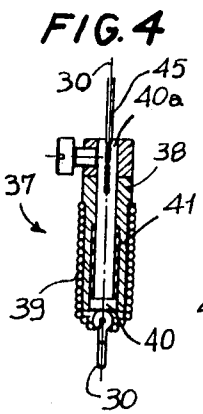
FIG. 4, in turn, shows a detail of FIG. 3 to a further enlarged scale.

Double-acting compensating devices 37 are arranged along the tie rods 30, as seen in FIG. 4. These compensating devices allow each hooked needle 21 to tension the corresponding tie rod 30 so that the corresponding crank can rotate without constraining the other hooked needle connected to the same crank to execute any shifting.

The compensating devices 37 may have different forms: the preferred one, as shown in FIG. 4, consists of a cylindrical body 38 integral to a first damping spring 39 and containing a plunger 40 therein, movable in opposition to a second damping spring 41. Each tie rod 30 engages, at one side of the cylindrical body 38, with the first damping spring 39 and at the other side of the same cylindrical body 38 with the rod 40*a* of plunger 40. Furthermore, the damping springs 39 and 41 are a pulling spring and a compression spring respectively and they act in opposite directions so as to make the attachment points of the tie rod 30 fundamentally as near as possible.

An important feature of these compensating devices 37 consists in that one of said springs, in this particular case spring 41, has a much lower stiffness than the other, so that it can act as a mere return spring when the device is not under stress.

Each plate 15 is integral to a supporting frame 42 fixed to a specific primary bar 43. Each primary bar 43 is engaged, through connecting pieces 44, with two bars disposed one above the other, in order to give the machine the greatest flexural strength along vertical planes.

Tie rods 30 are introduced in sheaths 45 formed from a tightly coiled wire. These sheaths 45 have a certain flexural strength and are spontaneously arc-connected to a frame 46 provided with horizontal guide channels 47 which extend as far as the hooked needles 21, located in the compartment 2*a*. Each guide channel 47 contains sheaths 45 that end to two opposed plates 15. Sheaths 45 are connected to supporting frames 42 where they are integral to sleeves 42*a* that can be disposed, by means of screw means, in the direction of development of the sheaths themselves. The positioning of sleeves 42*a* causes the shifting of sheaths and consequently the tensioning or releasing of the tie rods 30 (evenness) on wheels 29*a*, as the tie rods are tightly fitted into sheaths 45. Owing to the high number of sheaths 45 and to the resiliency thereof, the same sheaths exert a remarkable thrust on plates 15 towards the oscillating bar 16 (FIG. 1). Therefore, it is advantageously provided that the sheaths 45 thrust action should be balanced by a first compensating spring 48 acting in the opposite direction and adjustable by means of screw means.

We will now refer to FIGS. 7 to 10, that show the selection and control members accommodated in the compartment 2*a* and designed to actuate bars 13.

Said selection and control members include, as already mentioned, hooked needles 21, a trailing device 22, needles 23 for the control of said hooked needles, and a drum 24 for the selection of said needles. All these members are already known in themselves but they are arranged in a novel way as the hooked needles have a horizontal development and are held in their resting position by springs 49. Furthermore, the trailing device 22 acts by means of crosspieces or blades 50 disposed transversely to the hooked needles and movable in a horizontal direction. At their edges, blades 50 are integral to a plate 51 movable parallelly to the hooked needles 21 and controlled by a pair of thrust bars 52 actuated by a thrust unit 53. The latter is connected to a drive shaft 54 and, through an eccentric 55, it oscillates guided by two connecting rods 56, one of them being attached to a fixed point 57 and the other to a slider 58 integral to the thrust bars 52.

In order to balance the action of springs 49 on the thurst unit 53, a second compensating spring 59 is provided counteracting the action of springs 49. The second compensating spring 59 is inserted between the plate 51 and an envelope 60 integral to the bearing frame 2.

Figure 7:
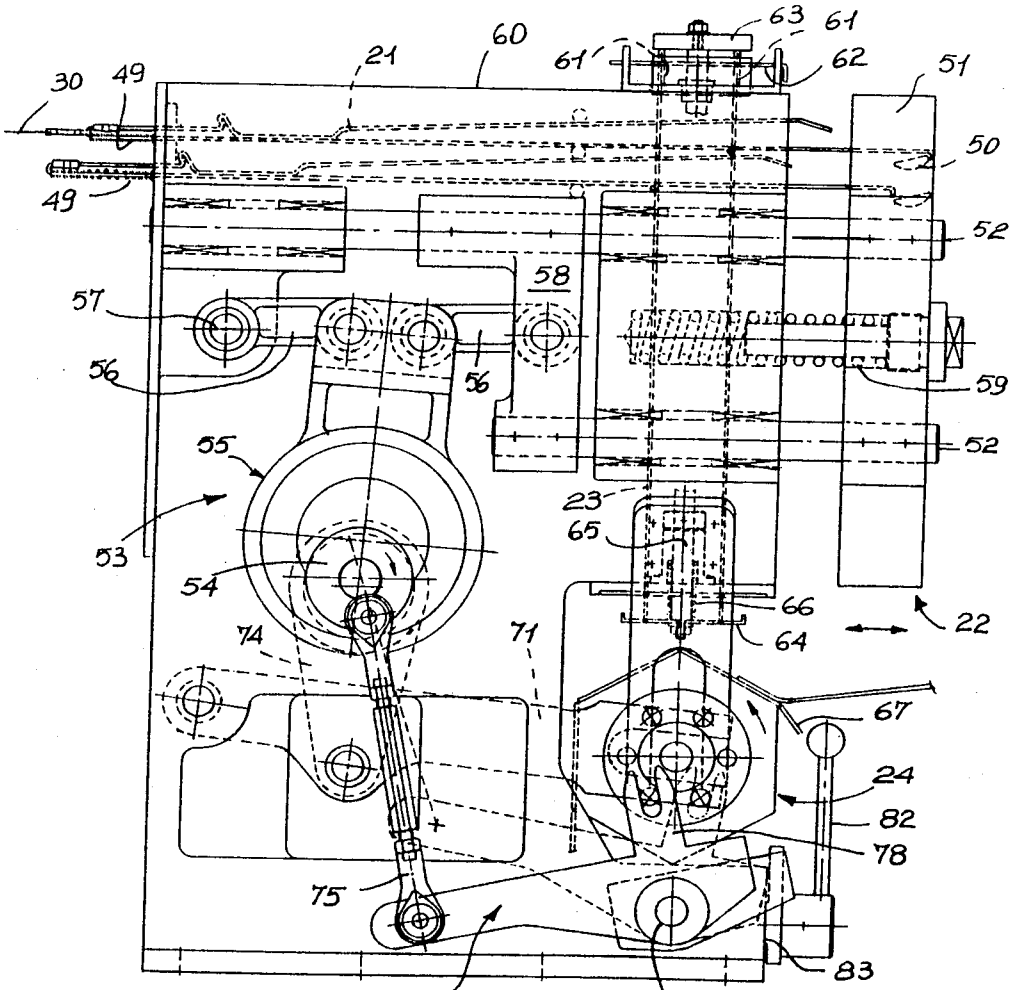
FIG. 7 is a front detailed view of a portion of the machine according to the invention, that portion being diagrammatically shown on the right-hand side of FIG. 1.
Figure 9:
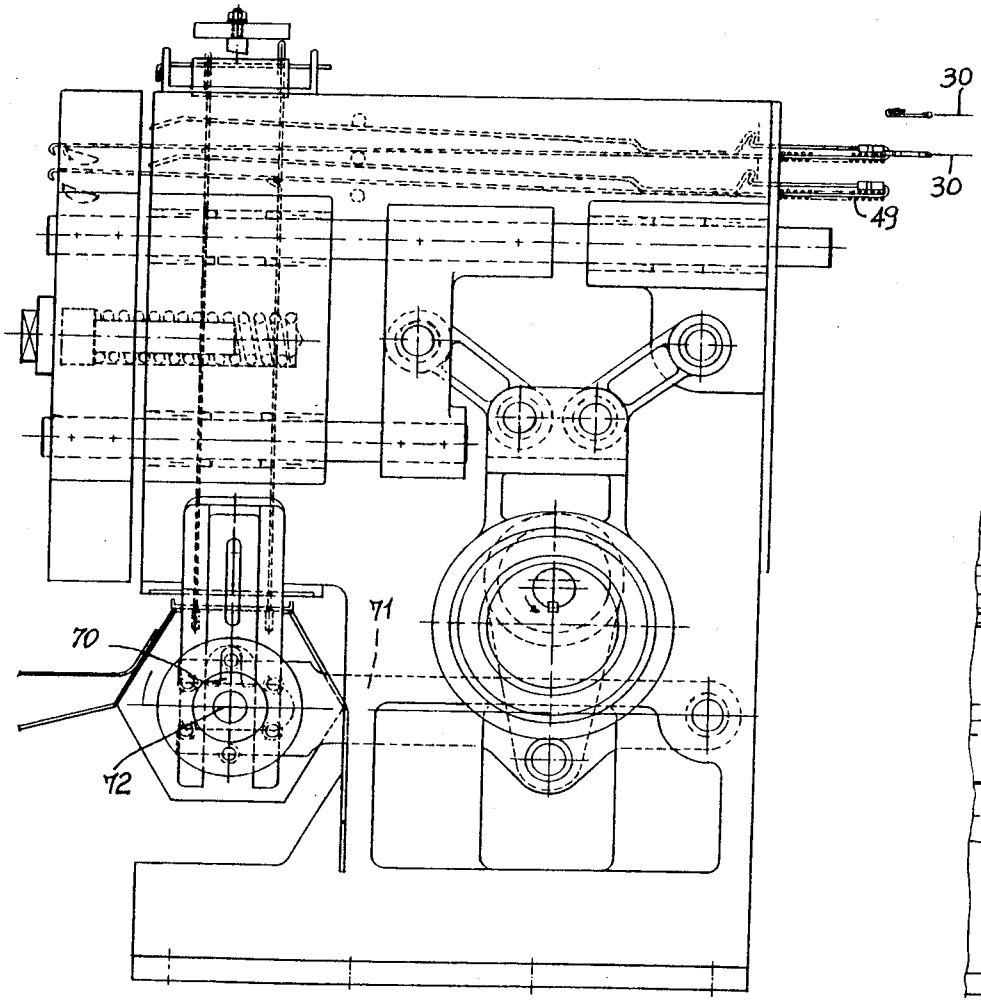
FIG. 9 shows the same machine portion seen in FIG. 7 but according to an opposite view.

As shown in FIGS. 7 and 9, needles 23 for the control of said hooked needles are substantially vertical and, at their upper ends provided with bent portions 61, they are hung up to a cross bar 62.

The bent portions 61 of the needles 23 controlling said hooked needles are opened so as to allow the lifting of the same needles in opposition to an upper pressing plate 63 which, together with a lower plate 64, "closes in a pack" the needles 23 for the control of said hooked needles. Said plates are centrally connected to each other and reciprocally integral by means of a vertical bar 65 adapted to be lifted at the inside of an envelope 60 in opposition to spring means 66.

The lower plate 64 is provided with a hole so as to allow the passage of needles 23 when it is lifted together with the vertical bar 65 and the upper plate 63. However, the cross bar 62 is not lifted together with the above members and needles 23 keep their hooked position with respect to the same cross bar 62.

The lifting of needles 23 controlling said hooked needles, together with plates 63 and 64 and with the vertical bar 65 is eventually controlled by drum 24 which can be raised so that one of the faces thereof can contact the lower plate 64 and lift the same. The drum 24 is combined, in a known manner, with cards 67 having a series of perforations, for conveying instructions to the knitting machine. The presence or absence of said perforations establishes the position of the needles 23 controlling said hooked needles and therefore the position of the same hooked needles 21 and of rods 13 connected thereto by means of the tie rods 30. The programming of the machine by means of the punched cards 67 is known in itself and therefore it will not be further explained.

However it should be observed that the working motion of drum 24 in the knitting machine according to the invention can be controlled in a very simple and precise manner. In fact, at one side of drum 24 a first disc 68 is provided (FIGS. 9 and 10) having first front projections 69 that, when the drum 24 is raised, are inserted into vertical elongated apertures 70 obtained on the fixed envelope 60. The lifting motion is independent of the movement of rotation and the first one is controlled, close to each side cover of the knitting machine according to the invention, by a forked lever 71 slidably engaging the main shaft 72 of drum 24 in a direction parallel to its own axis of development. The engagement between the forked lever 71 and the main shaft 72 occurs by means of a joining ring 73 rotatable with respect to the main shaft 72 and provided with chamfered portions, so that the flat surfaces thereof can contact the forked lever 71. Each forked lever 71 is controlled by the drive shaft 54 by means of a further lever 74.

Figure 8:
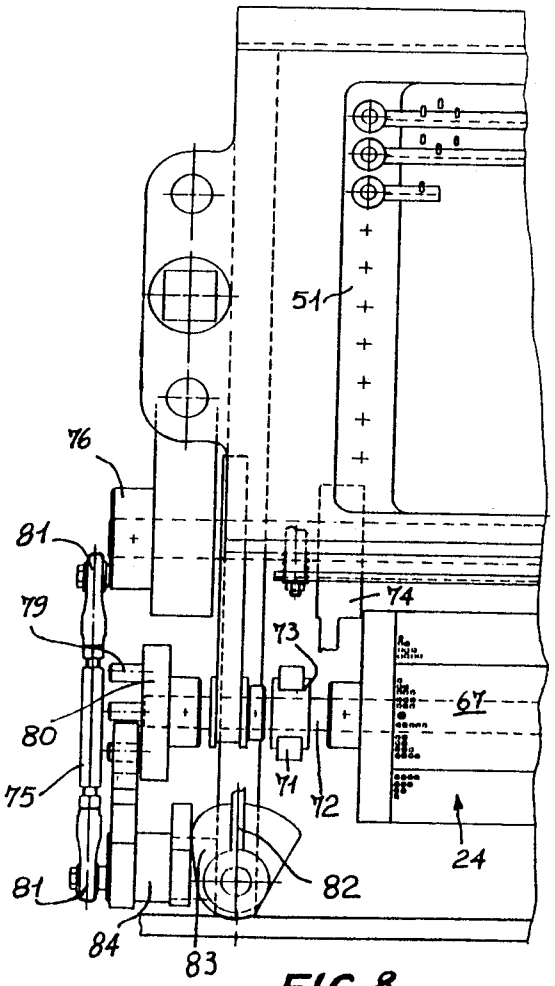
FIG. 8 is a part side view of FIG. 1 and of a side of said machine.
Figure 10:
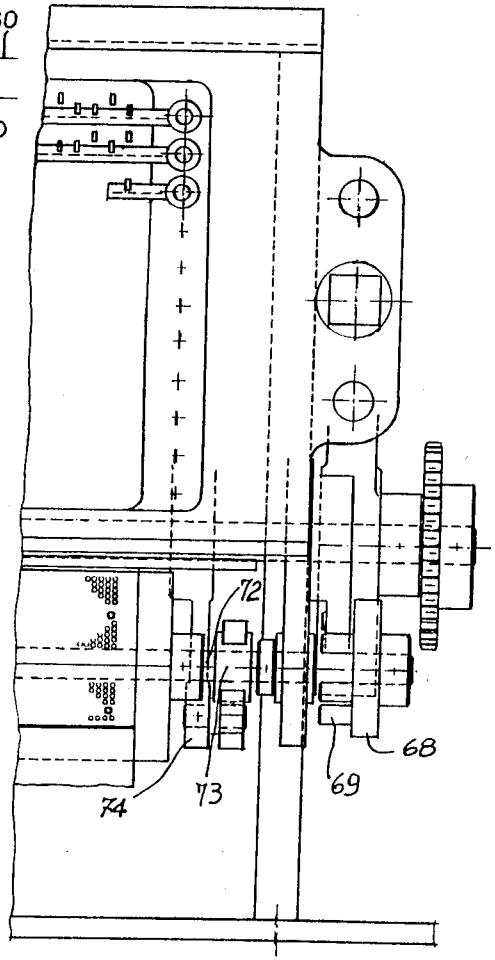
FIG. 10 is a part side view of FIG. 9 and shows a further portion of the same side of the machine seen in FIG. 8, this portion being an extension thereof.

The movement of rotation of drum 24 is, on the contrary, controlled by a connecting rod 75 connected to a crank 76 fitted at one end of the drive shaft 54, as shown in FIGS. 7 and 8. The connecting rod 75 is pivotally mounted on one end of a rocker 77 slidably engaging, by means of a fork-shaped lug, the second front abutments 79 of a second disc 80 that is secured on the main shaft 72 at the opposite side with respect to the first disc 68.

As shown in FIGS. 7 and 8, the connecting rod 75 is provided at its ends with ball joints 81 and the rocker 77 is movable in a direction away from the second disc 70 by action of a hand control lever 82 integral to a cam 83 working in direction of the rocker 77. The latter is provided with an axially slidable articulated member 84 which allows the rocker 77 to be spaced apart from the second disc 80.

After what has been described above, the operation of the different mechanical members of the weaving machine according to the invention appears evident due to the simplicity of the same members and to the fact that many remarks concerning the operation of said machine have already been made for the sake of clearness, during the above description.

On the contrary, the different working possibilities of this machine depending upon the above described structure are clearly explained in FIGS. 11 to 19.

In these figures the following members are diagrammatically shown: tubular weft yarn guides 7, rods 13, plates 15, the front grooved bar 7, needles 6, the warp yarn 12 and the weft yarn 85 that is supplied through the tubular weft yarn guides 14. Furthermore, the oscillations of plates 15 are indicated by the arrow 86 and it is understood that these oscillations are of a known type, i.e. they have the same amplitude than the distance between two adjacent needles 6.

Figure 11:
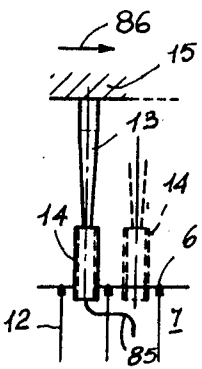
FIGS. 11 and 12 are diagrammatic views showing the operation of the machine when traditional workings are carried out.
Figure 12:
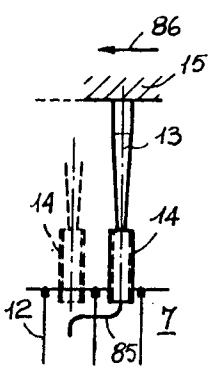

Above all, it must be pointed out that the knitting machine according to the invention can behave like a common knitting machine of the known type. In fact, as shown in FIGS. 11 and 12, when rods 13 keep their intermediate vertical position between the maximal oscillations thereof, the weft yarn 85 can be formed into loops in correspondence of a single needle.

Figure 15:
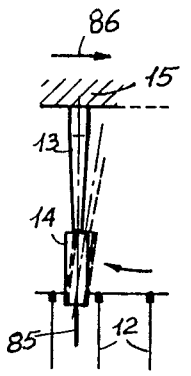
Figure 16:
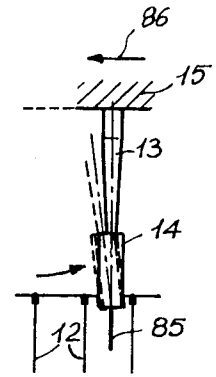

Furthermore and in a novel way, the machine can make no loops and therefore deactivate the action of the jacquard device when the angular oscillations take place, as shown in FIGS. 15 and 16, in the opposite direction with respect to the shiftings of plates 15 and over a way corresponding to the distance between two needles 6.

Figure 13:
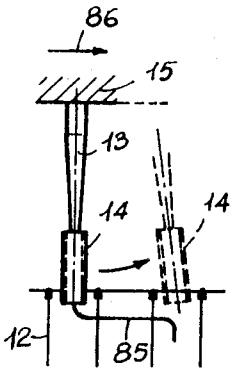
FIGS. 13 to 18 show new and specific ways of working of the machine according to the invention.
Figure 14:
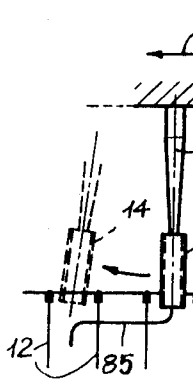
Figure 17:
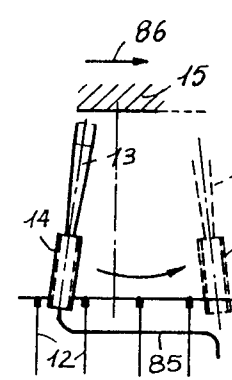
Figure 18:
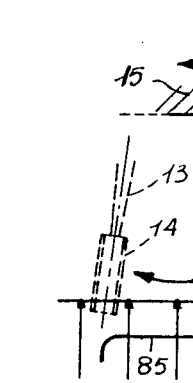

On the contrary, if angular oscillations of rods 13 in the same direction than the shiftings of plates 15 are utilized, it is possible to obtain two loops, as shown in FIGS. 13 and 14, or even three loops, as shown in FIGS. 17 and 18. The obtention of three loops is possible when rods 13 start from a shifted position that therefore does not coincide with the intermediate one.

Figure 19:
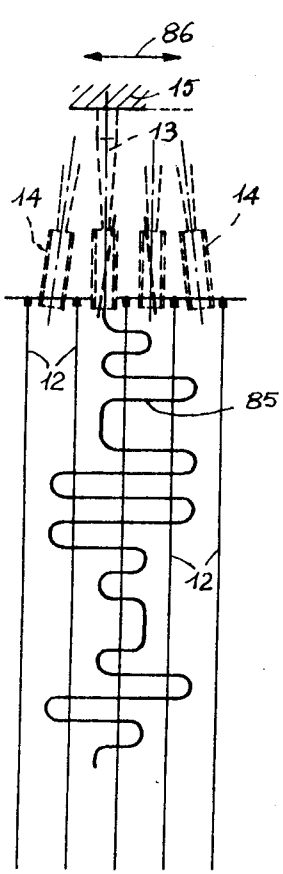
FIG. 19 shows a sequence of working steps in which the steps shown in FIGS. 11 to 18 are combined.

FIG. 19 shows, by way of example only, how all the movements shown in FIGS. 11 to 18 can be combined together: practically, it is already possible to create patterns between the warp yarns by means of a single rod 13.

The invention attains the intended objects. The knitting machine thus obtained is suitable to carry out all kinds of figured fabrics by simply changing the program controlling the machine operation, by means of the selection drum 24, but it also exhibits a simple structure, a balanced operation and reduced dimensions particularly as to its height.

Though the machine is fundamentally novel, it can easily be utilized by operators skilled in the pre-existent knitting machines and all the different members thereof can be readily replaced or eliminated. By the hand control lever 82 it is also possible a hand control of drum 24.

The embodiment of the invention described above is not intended to comprise a limitation and modifications can be carried out within the scope of the following claims. Furthermore, all details can be replaced by technically equivalent elements. Practically the materials, shapes and sizes can be whatever according to the requirements.

What is claimed is:

1. An improved knitting machine for the production of figured fabrics, that is, having different colors and patterns, of the kind associated with a crochet-machine and a jacquard device on a sole bearing frame and comprising:

active members such as a needle-bar movable in an axial direction to the needles, a warp yarn guide bar disposed adjacent the needles and suitable to oscillate in a direction parallel to the lying plane of the needles and to rotate perpendicularly to the same plane, an under-yarn guide bar suitable to oscillate in a direction parallel to the needle plane and perpendicularly to the same, a projection carrier bar movable at right angles to the needle plane, rods suitable to support tubular weft yarn guides disposed side by side on plates parallel to said needle bar and transversely to the needle plane, said plates being movable along their own plane and parallelly to said needle bar in order to define the working oscillations of said rods;

selection and control members for said active members designed to cause the same active members to intervene according to a predetermined program;

feeding devices for the yarns forming the fabric; and conveying means for the produced fabric; characterized in that said rods are rotatably supported by pivot pins extending at right angles to said plates, as well as stop members for oscillations of said rods, adapted to allow the rods to oscillate symmetrically with respect to vertical planes and to cause the maximal linear amplitudes of said tubular weft yarn guides which correspond to the double distance of two needles in succession, and in that said selection and control members include a plurality of kinematic chains suitable to position each of said rods angularly and independently of the adjacent rods.

2. A knitting machine according to claim 1, characterized in that said stop members consist of fixed abutments integral to said plates and disposed symmetrically to the pivot pins that protrude from said plates.

3. A knitting machine according to claim 1, characterized in that said kinematic chains, which are suitable to angularly position each rod independently of the adjacent rods, comprise cranks for controlling the angular oscillations of the rods, tie rods for said cranks connecting the cranks to hooked needles movable by means of a trailing device, said hooked needles being positioned by means of control needles controlling the said hooked needles, which control needles in turn are controlled by a selection drum.

4. A knitting machine according to claim 3, characterized in that each crank comprises a wheel rotatable about its central axis and provided on its edge with a peg adapted to be introduced into an end slot obtained in said rod and in that two tie rods are provided for each of said cranks, said tie rods surrounding the crank itself on opposed sides and being integral at their ends to said crank and each of said tie rods being attached to a specific hooked needle.

5. A knitting machine according to claim 4, characterized in that each tie rod is provided, along its development, with a compensating device formed from a cylindrical body integral to one spring, in which a plunger is slidably introduced and which is movable in opposition to a second spring having a lower stiffness than the preceding spring, said tie rod engaging, on opposed sides, with said first spring and said plunger and said springs working in such a way that they cause the approaching of said tie rod ends.

6. A knitting machine according to claim 1, characterized in that return springs are provided to counteract the angular oscillations of said rods, said springs being interposed between the sides of the same rods and fixed projections protruding from said plates.

7. A knitting machine according to claim 1, characterized in that each of said plates is integral to a primary bar parallel to the needle bar and in that said primary bar engages with two further bars parallel thereto by means of connecting plates.

8. A knitting machine according to claim 1, characterized in that said active members, which are movable in a vertical direction, are controlled by a column-shaped support integral, during its displacements, to a cam follower that is introduced in a movable manner into a double cam and in that said column-shaped support is balanced by a support spring which is disposed between the column-shaped support and the bearing frame, said support spring being adjusted so that it can substantially bear the whole weight exerting a pressure on said cam follower.

9. An knitting machine for the production of figured fabrics, that is, having different colors and patterns, of the kind associated with a crochet-machine and a jacquard device on a sole bearing frame, provided with active members and selection and control members for said active members at the level of the needles, particularly for rods supporting tubular weft yarn guides that represent end elements of said jacquard device, comprising hooked needles, a trailing device for said hooked needles, control needles for controlling said hooked needles and a drum for the selection of said needles, characterized in that said selection and control members are disposed at the side of said active members and in that tie rods are provided between said hooked needles and said rods, said tie rods being developed prevalently in a horizontal direction on a frame mounted above the rods supporting the yarn guides, said tie rods being at the inside of resilient sheaths.

10. A knitting machine according to claim 9, characterized in that a thrust action of the sheaths on said tie rods and plates is balanced by a first compensating spring.

11. A knitting machine according to claim 9, characterized in that the ends of said sheaths are integral, on said plates, to sleeves that can be positioned along the axes of the same plates by means of screw means, and in that the tension adjustment of said tie rods is carried out by axially positioning said sleeves.

12. A knitting machine according to claim 9, characterized in that said hooked needles are horizontally disposed and associated with springs adapted to lead the hooked needles to their resting position and in that said trailing device is provided with a second compensating spring working in the opposite direction with respect to other springs.

13. A knitting machine according to claim 9, characterized in that the control needles for controlling said hooked needles are disposed in a substantially vertical direction and are hung up at one end thereof, said control needles being provided with bent and opened upper end portions so as to allow the vertical lifting of the hooked needles.

14. A knitting machine according to claim 13, characterized in that the control needles controlling said hooked needles are guided at the level of their lower end turned towards said drum, by a drilled lower plate that can be raised by means of the drum itself in opposition to spring means.

15. A knitting machine according to claim 9, characterized in that said drum is associated with lifting means and with rotation means separated from each other.

16. A knitting machine according to claim 15, characterized in that said lifting means comprises forked-levers that can oscillate along vertical planes and are suitable to insert abutments integral to said drum into fixed vertical elongated apertures.

17. A knitting machine according to claim 15, characterized in that said rotation means comprises a rocker connected to a drive shaft by means of ball-joints and susceptible of being disengaged by means of a hand control lever.

* * * * *